US005853934A

United States Patent [19]

Watanabe et al.

[11] Patent Number: 5,853,934

[45] Date of Patent: Dec. 29, 1998

[54] ELECTROPHOTOGRAPHIC PHOTORECEPTOR

[75] Inventors: Kazumasa Watanabe; Shingo Fujimoto; Naoto Abe, all of Hino; Hideo Yoshizawa, Hachioji; Tsuyoshi Shimoda, Hachioji; Yohko Kitahara, Hachioji, all of Japan

[73] Assignee: Konica Corporation, Tokyo, Japan

[21] Appl. No.: 896,846

[22] Filed: Jul. 18, 1997

[30] Foreign Application Priority Data

Jul. 24, 1996 [JP] Japan ..... 8-194674

[51] Int. Cl.[6] ..... G03G 5/043

[52] U.S. Cl. ..... 430/59

[58] Field of Search ..... 430/56, 58, 59

[56] References Cited

U.S. PATENT DOCUMENTS

| | | | |
|---|---|---|---|
| 5,130,222 | 7/1992 | Otsuka et al. | 430/59 |
| 5,286,588 | 2/1994 | Suzuki | 430/58 |
| 5,380,613 | 1/1995 | Ueda et al. | 430/58 |
| 5,587,263 | 12/1996 | Nukada et al. | 430/56 |
| 5,616,442 | 4/1997 | Kanemaru et al. | 430/96 |

FOREIGN PATENT DOCUMENTS 0 699 962 A1 3/1996 European Pat. Off. .

*Primary Examiner*—John L Goodrow

*Attorney, Agent, or Firm*—Frishauf, Holtz, Goodman, Langer & Chick, P.C.

[57] ABSTRACT

Disclosed is an electrophotographic photoreceptor comprising a substrate and provided thereon, a photosensitive layer comprising a charge generation material, a triarylamine charge transport material, and a compound represented by Formula 1:

Formula 1 wherein $R_1$ represents a secondary or tertiary alkyl group; $R_2$ represents a halogen atom, an alkyl group, an aryl group or an alkoxyl group; n represents an integer of 0 to 3, and Ar represents an aryl group.

14 Claims, No Drawings

ELECTROPHOTOGRAPHIC PHOTORECEPTOR

FIELD OF THE INVENTION

The present invention relates to an electrophotographic photoreceptor.

BACKGROUND OF THE INVENTION

Conventionally, in the electrophotographic imaging apparatuses utilizing the Carlson process, inorganic photoreceptors such as selenium and the like have been employed. However, organic photoreceptors have been increasingly employed because of the problem of the crystallization of amorphous selenium and the adverse effect to the environment when disposed as the industrial waste.

Furthermore, the organic photoreceptors have made remarkable progress, since the conception was born wherein the generation of photo charges and the electrification ability of the surface of the photoreceptor are functionally separated. In a charge generation layer employed as a lower layer, has been improved quantum efficiency in azo pigments, phthalocyanine pigments, condensed polycyclic pigments, and the like. In a charge transport layer employed as an upper layer, charge mobility has been enhanced through the improvement in amine-based compounds enabling positive hole transport. Accordingly, have been developed the organic photoreceptors superior to inorganic ones in terms of sensitivity.

However, at present, all the problems on the photoreceptors have not be solved. The electrophotographic process includes charging the surface of the photoreceptor followed by the formation of an electrostatic latent image upon exposure. The resulting electrostatic latent image is then developed with a toner and a visible image is transferred to a material such as paper and fixed to obtain the image. The photoreceptor is repeatedly utilized for a long period of time, while it is subjected to the removal of the toner remaining on the surface, discharging, and cleaning of the surface.

Accordingly, as for the electrophotographic photoreceptors, improvements have been required in electrophotographic properties such as excellent electrification characteristics and sensitivity, and further, small dark decay; physical durability such as printing durability at the repeated use, anti-abrasion, moisuture durability, etc. and chemical durability such as durability against ozone and nitrogen oxides, and ultraviolet rays at exposure, etc.

Image unsharpness is considered as one of phenomena caused by the lack of the chemical durability. The image unsharpness is one of the big problems which are not obviated at present. As causes, there have been estimated nitrogen oxides generated by kerosene heaters during winter, ozone generated by corona chargers and further, nitrogen oxides formed by reacting the resulting ozone with nitrogen in ambient air (Kobayashi, Sato, et al, J. of Imaging Sci. and Tech. Vol. 39, Nov. 6, 1995, p. 485).

Conventionally, in order to increase the durability against these kinds of oxidizing substances, the addition of hindered phenol compounds and hindered amine compounds have been investigated (Japanese Patent Publication Open to Public Inspection Nos. 63-18356, 63-50849, 63-73256 and 8-123055).

However, when attempting the improvement in the chemical durability with the use of antioxidants, another problem is caused. Namely, the hindered amine compounds are liable to work as a cation trap as always observed in the amine compounds and are apt to increase a residual potential and decrease sensitivity. In addition, the hindered phenol compounds which are electrically inactive and are expected to cause no adverse effect to the properties of the photoreceptors are insulating materials as always observed in organic substances. As a result, the concentration of a charge transport material (hereinafter referred to as CTM) in the photoreceptor is lowered and the decrease in sensitivity and the increase in the residual potential are caused.

This trend is further enhanced for amine-based compounds. In accordance with the recent requirements for high speed copying with the improved durability, the problem has become more serious.

SUMMARY OF THE INVENTION

An object of the present invention is to provide a high speed photoreceptor which is friendly to the environment and highly durable against ozone, and results in no degradation of electrification properties during the repeated use and no decrease in sensitivity, and produces high quality images.

In the present invention, the photoreceptors are described.

Item 1. An electrophotographic photoreceptor comprising a compound represented by Formula 1 and a triarylamine charge transport compound:

Formula 1

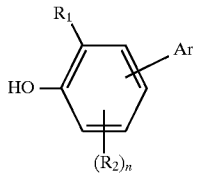

wherein $R_1$ represents a secondary or tertiary alkyl group; $R_2$ represents a halogen atom, an alkyl group, an aryl group or an alkoxyl group; n represents an integer of 0 to 3, and Ar represents an aryl group.

Item 2. The electrophotographic photoreceptor of item 1 wherein Ar is a phenyl group.

Item 3. The electrophotographic photoreceptor of items 1 or 2 wherein the triarylamine compound is a triphenylamine compound.

Item 4. The electrophotographic photoreceptor of item 3 wherein the triarylamine compound is represented by following Formulas 2 to 5:

Formula 2

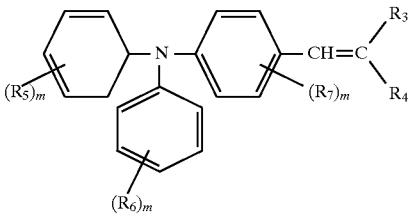

Formula 3

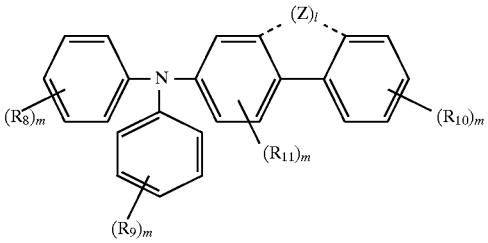

Formula 4

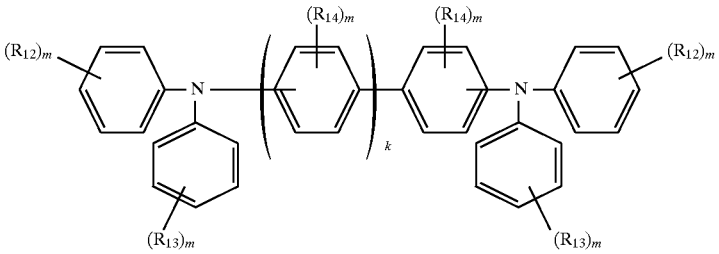

Formula 5

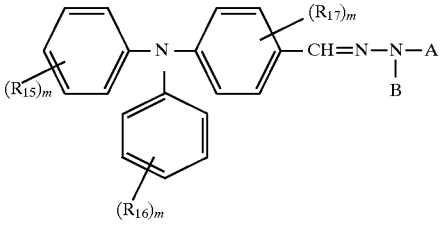

(wherein $R_3$ represents a phenyl group; $R_4$ represents a hydrogen atom or a phenyl group; $R_5$ to $R_{17}$ each represent, a halogen atom, an alkyl group or an alkoxy group; m represents an integer of 0 to 3; A and B each represent an alkyl group or an aryl group; A and B may be combined to form a ring; Z represents a bonding group; l is 0 or 1 and k represents 0 or 1.)

DETAILED DESCRIPTION OF THE INVENTION

In Formula 1, $R_1$ is positioned at the o (ortho) position of OH group and represents a secondary or tertiary alkyl group. The secondary or tertiary alkyl group can include, for example, an isopropyl group, a t-butyl group or an isoamyl group. $R_2$ represents an alkyl group (as a secondary or tertiary alkyl group, for example, preferably an isopropyl group, a t-butyl group or an isoamyl group), an aryl group, an alkoxyl group, or a halogen atom and n is an integer of 0 to 3 and n is preferably 1.

The alkyl groups include, for example, primary alkyl groups such as a methyl group, an ethyl group, a propyl group, an octyl group or a 2-ethylhexyl group or the above-mentioned secondary or tertiary alkyl groups; alkoxyl groups such as a methoxy group or an ethoxy group, and aryl groups such as a phenyl group or a naphthyl group. Ar represents an aryl group and preferably a phenol group. Substituents on Ar may include an alkyl group, an alcoxyl group, a halogen atom, a nitro group, a cyano group or an ester group. The substituting position of Ar is preferably an o (ortho) or p (para) position of the OH group and more preferably the p (para) position.

In the present invention, triarylamine compounds contain a basic structure (preferably, triphenylamine structure) in one part of the molecule. The preferred compounds are represented by the above-mentioned Formulas 2 to 5.

The compounds represented by Formula 2 may be available on the market or may be prepared by referring to Japanese Patent Publication Open to Public Inspection Nos. 60-175052, 58-65440 and 60-98437; the compounds represented by Formula 3 may be available on the market or may be prepared by referring to Japanese Patent Publication Open to Public inspection Nos. 2-230255 and 2-178668; the compounds represented by Formula 4 may be available on the market or may be prepared by referring to Japanese Patent Publication Open to Public Inspection Nos. 62-267749 and 61-132955; the compounds represented by Formula 5 may be available on the market or may be prepared by referring to Japanese Patent Publication Open to Public Inspection Nos. 62-201453 and 5 8-166354.

In Formula 2, $R_3$ represents a phenyl group, and $R_4$ represents a hydrogen atom or a phenyl group. $R_3$ and $R_4$ each may have substituents such as an alkyl group, an alkoxyl group, a halogen atom, a nitro group, a cyano group, an ester group, etc. $R_5$, $R_6$ and $R_7$ each represent an alkyl group, an alkoxyl group, or a halogen atom, which are directly substituted to the basic structure of triphenylamine and m is 0 to 3.

In Formula 3, Z represents a bonding group; l is 0 or 1; Z preferably represents an atomic group required for forming a 5- or 6-membered ring, more preferably a methine chain. The methine chain and the above-mentioned 5- or 6-membered ring may have substituents. Further, $R_8$, $R_9$, $R_{10}$ and $R_{11}$ each represent an alkyl group, an alkoxyl group or a halogen atom, a hydrogen atom and m represents an integer of 1 to 3.

In Formula 4, k represents an integer of 0 or 1 and $R_{12}$, $R_{13}$ and $R_{14}$ each represent an alkyl group, an alkoxyl group, a halogen atom or a hydrogen atom and m is an integer of 1 to 3.

In Formula 5, A or B represents independently an alkyl group, or an aryl group, and A and B may be combined to form a ring. $R_{15}$, $R_{16}$ and $R_{17}$ each represent an alkyl group, an alkoxyl group, or a halogen atom, a hydrogen atom and m represents an integer of 1 to 3. This ring is preferably a nitrogen containing 5- or 6-membered heterocyclic ring and the above-mentioned heterocyclic rings may form a condensed ring comprising a benzene ring, etc. and may have a substituent.

In a group of those compounds, particularly preferred compounds are those which are represented by the Formulas 2 to 4 wherein those compounds represented by Formulas 2 to 4, have high charge mobility.

In a photoreceptor utilizing a triaryl compound as a charge transport material (positive hole transport material), when a compound represented by Formula 1 is employed as an antioxidant, the sensitivity is rather increased in spite of the addition of the insulating organic compound.

Examples of the compounds of the present invention are illustrated.

Specific examples of compounds represented by Formula 1 include:

P-1

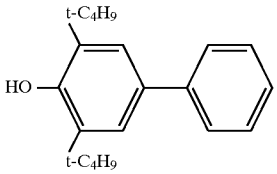

P-2

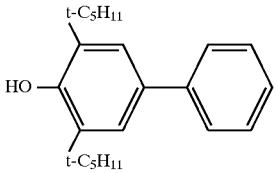

P-3

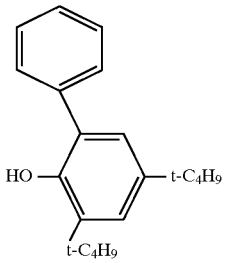

-continued

P-4

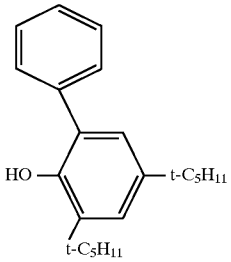

P-5

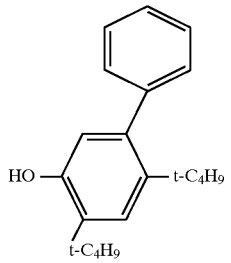

P-6

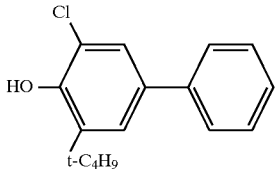

P-7

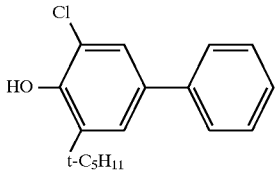

P-8

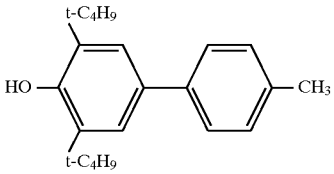

P-9

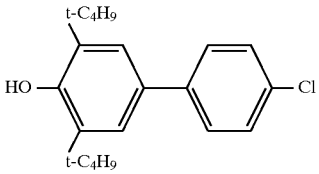

P-10

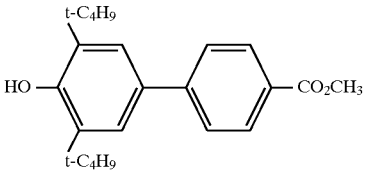

P-11

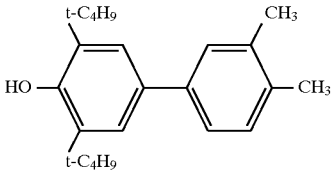

The compounds of the present invention represented by Formula 1 are synthesized by various methods. A method described in Gordon H. Stillson, David W. Sawyer et al, J.

Amer. Chem. Soc. Vol. 67, 1945, p. 303, will be listed as one of the methods, wherein isobutylene gas is blown through a phenol compound (no substituent at 2 or 6 position) in the presence of an acid catalyst.

Specifically, scheme is described as follows.

Synthesis Example (Synthesis of Compound P-1)

120 g of 4-phenylphenol was dispersed into 500 ml of toluene and 3 ml of sulfuric acid was added. Isobutene (gas, 100 g) was then blown through the resulting mixture for 6 hours. After the completion of the reaction, the resulting solution was diluted by toluene and washed by alkali. The desired product was obtained by distillation under reduced pressure (145° to 150° C./2 mmHg).

(White crystal 130 g, yield=63%, mp 101° C.)

In the following, specific examples of compounds represented by the above-mentioned Formulas 2 to 5 are illustrated.

Specific examples of compounds represented by Formula 2:

(2-1)

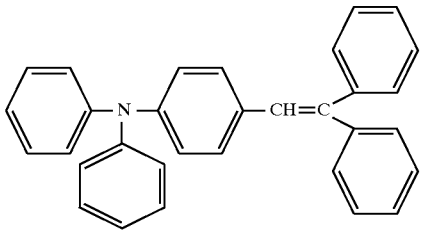

(2-2)

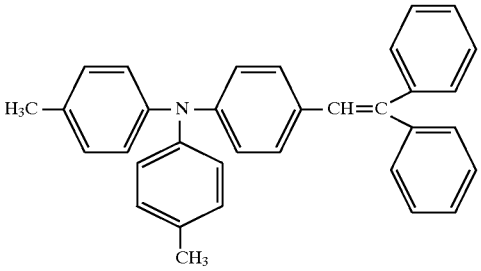

(2-3)

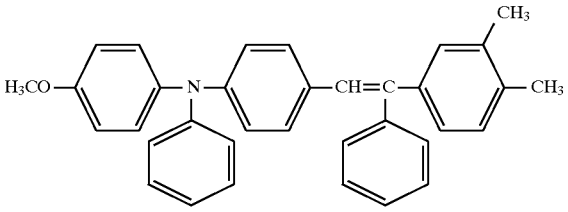

(2-4)

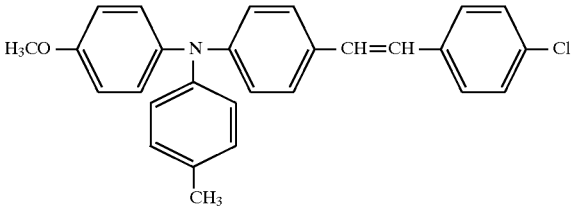

-continued (2-5)

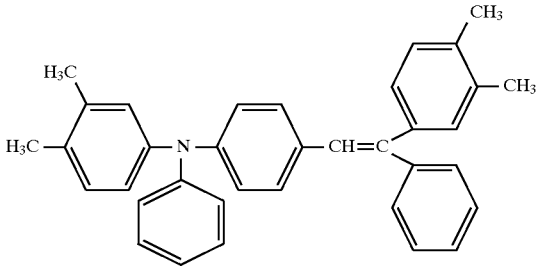

(2-6)

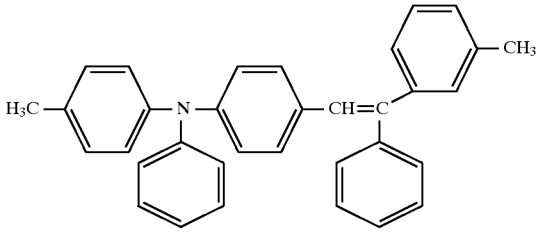

(2-7)

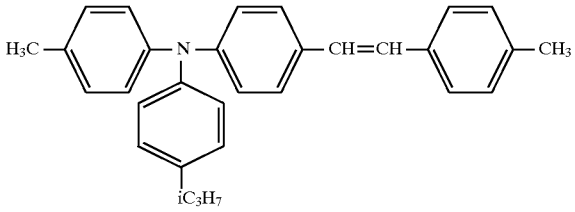

(2-8)

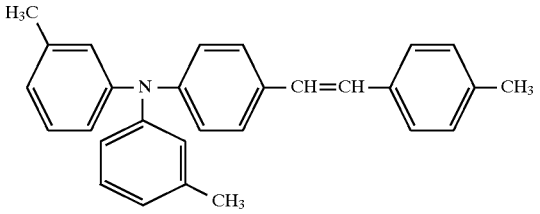

(2-9)

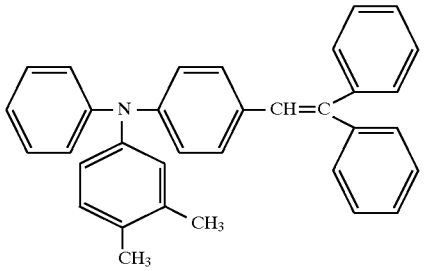

(2-10)

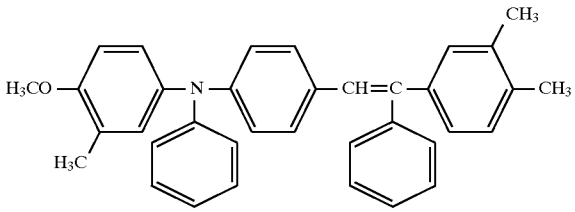

-continued
(2-11)
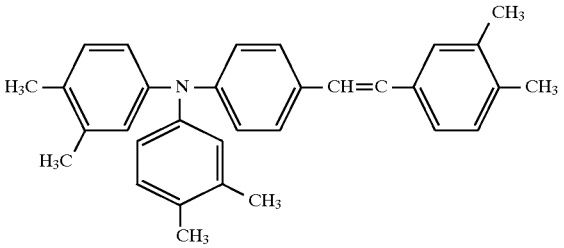
Specific examples of compounds represented by Formula 3:
(3-1)
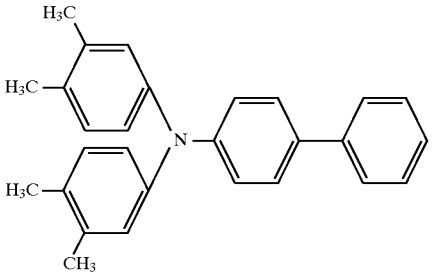
(3-2)
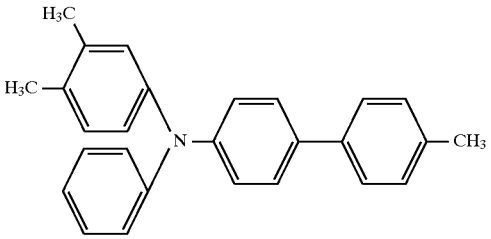
(3-3)
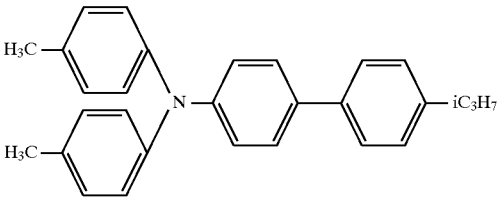
(3-4)
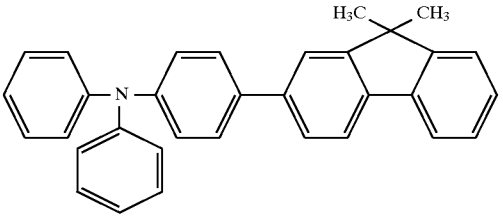
(3-5)
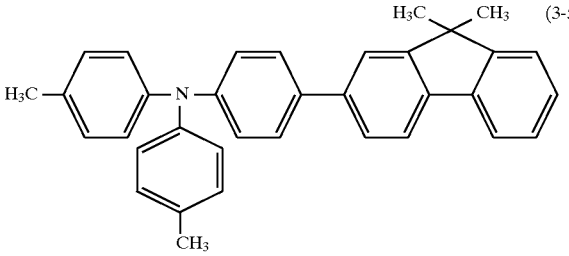
-continued
(3-6)
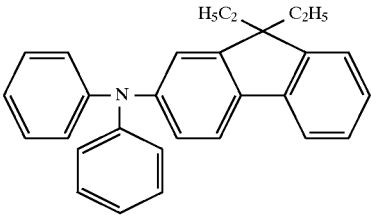
Specific examples of compounds represented by Formula 4:
(4-1)
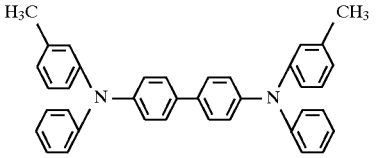
(4-2)
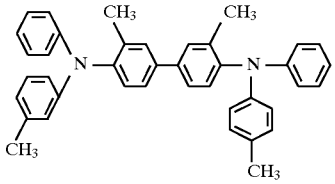
(4-3)
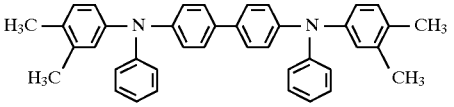
(4-4)
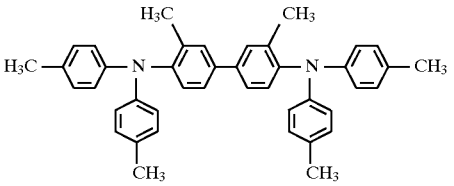
(4-5)
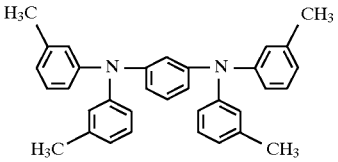
(4-6)
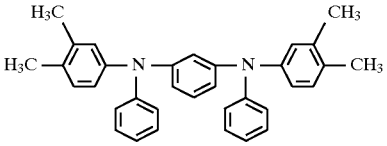
(4-7)
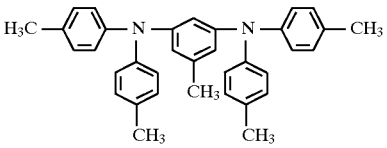

Specific examples of compounds represented by Formula 5:

(5-1)

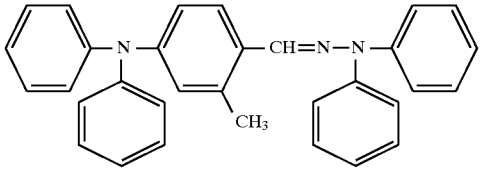

(5-2)

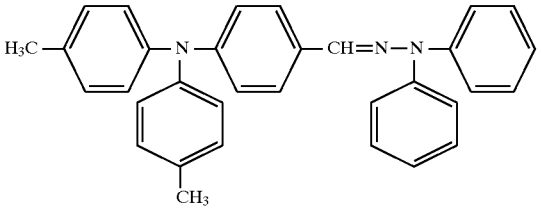

(5-3)

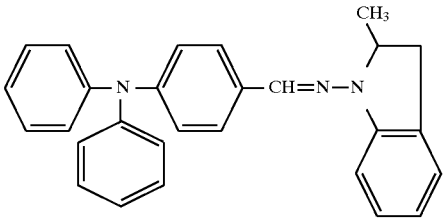

(5-4)

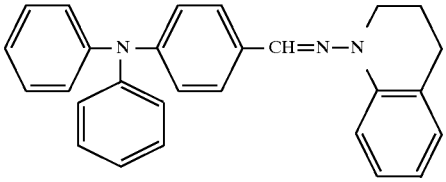

(5-5)

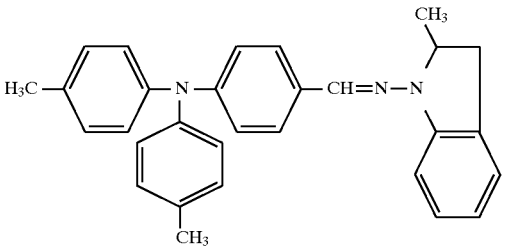

As mentioned above, the compounds represented by Formula 1 employed in the present invention function as antioxidants. However, when the compound represented by Formula 1 is incorporated into an electrophotographic photoreceptor, the unexpected effect which has not been obtained by conventional antioxidants was found.

Generally, when a large amount of ordinary organic compounds having no adverse electrphotographic effect are incorporated into a photoreceptor, the concentration of the charge transport material (CTM) , one of basic photosensitive materials, is lowered, and as a result, the decrease in the sensitivity is caused. On the contrary, the compounds represented by Formula 1 are excellent materials which result in sensitivity enhancing effect without causing the decrease in the sensitivity.

The sensitivity enhancing effect is remarkably realized when combined with triphenylamine charge transport material.

In the present invention, it is possible to employ known compounds as the charge generation material (hereinafter, referred to as CGM) employed in the present invention. The examples include azo pigments, phthalocyanine pigments, antharaquinone pigments, imidazoleperylene pigments, anthanthrone pigments and the like. The CGM and the charge transport material (CTM=positive hole transport material) employed in the present invention are dispersed using a known binder or dissolved followed by coating on a support. Thus a photoreceptor is prepared.

As binders, are included polycarbonate resins, polystyrene resins, silicone resins, polyester resins, polyamide resins and the like.

Furthermore, in the photoreceptor of the present invention, it is possible to utilize an intermediate layer between a conductive supporting substrate and a photosensitive layer in order to improve the adhesion and prevent the charge injection from the conductive supporting substrate.

As for materials incorporated in the intermediate layer, it is possible to utilize known polymers available for adhesives, for example, polyamide resins, polybutyral resins, polyvinyl acetate, etc. Besides those, it is possible to illustrate condensates of partially hydrolyzed products of metal alkoxides (for example, zirconium alkoxide, titanium alkoxide, etc.) which are known as a ceramic subbing.

Furthermore, the photoreceptor of the present invention may be provided with a protective layer.

The compounds of the present invention represented by Formula 1 can be added to a negatively charged function separating photoreceptor and a single-layered photoreceptor and further a reverse-layered photoreceptor.

The compounds of the present invention represented by Formula 1 can be added to an intermediate layer, an photosensitive layer or a protective layer of the photoreceptor. The compounds represented by Formula 1 are preferably added to the photosensitive layer and more preferably added to a layer containing the charge transport material (CTM). An addition amount of the compound represented by Formula 1 is in the range of 0.1 to 100 weight percent of the triarylamine CTM and preferably in the range of 1 to 50 weight percent.

When added to the protective layer (hereinafter referred to as OCL), an addition amount is in the range of 0.1 to 100 weight percent of a binder resin in OCL and preferably in the range of 1 to 50 weight percent. Furthermore, the photoreceptor of the present invention may comprise a CTM compound other than the triarylamine charge transport compound.

EXAMPLE

In the following, the present invention is explained in detail with reference to Examples.

Example A

Preparation of Photoreceptors P-1, P-2, P-3, P-4, P-8 and P-9 of the Present Invention 30 g of polyamide resin (CM8000 manufactured by TORAY INDUSTRIES, INC.) was put in a mixed solvent consisting of 900 ml of methanol and 100 ml of butanol, and was dissolved at 50° C. upon heating. The resulting solution was cooled to room temperature and was then dip coated on an aluminum drum having an outer diameter of 80 mm. Thus, an intermediate layer having a thickness of 0.5 $\mu$m was formed.

Subsequently, 5 g of polyvinyl butyral resin (Eslec BX-L manufactured by Sekisui Chemical Co., Ltd.) was dissolved into 1000 ml of methyl ethyl ketone, and 10 g of a charge generation material (CGM-1) was dispersed into the resulting solution for 10 hours using a sand mill. The resulting dispersion was dip coated on the above-mentioned intermediate layer, and a charge generation layer (hereinafter referred to as CGL) having a thickness of 0.5 μm was formed. Subsequently, 200 g of a charge transport material (2–3), 280 g of polycarbonate resin (Z200 manufactured by MITSUBISHI GAS CHEMICAL CO., INC.) and 20 g of each of the compounds (P-1 to P-4, P-8 and P-9) of the present invention was dissolved into 20 g of dichloromethane and thus coating solutions P-1 to P-4, P-8 and P-9 were prepared. Each of the resulting coating solutions was dip coated on the above-mentioned CGL to form a charge transport layer (hereinafter referred to as CTL) having a thickness of 25 μm. The resulting coating was heated at 100 ° C. and dried for 1 hour. Thus, the photoreceptors P-1 to P-4, P-8 and P-9 of the present invention were obtained.

Preparation of Comparative Photoreceptors 01, 02,,H-1, H-2, A-1 and AH-1

Comparative photoreceptors were prepared in the same manner as in Example P-1 except that in Example P-1, no antioxidant was added (01); instead of the antioxidant, the polycarbonate resin was added so as to make the CTM concentration same as that of Example (02); further, known antioxidants (A-1, H-1, H-2 and AH-1) were employed instead of the compounds of the present invention.

Evaluation

The photoreceptors of Examples and Comparative Example prepared as mentioned above were loaded to a copier (U-BIX 4045 manufactured by KONICA CORP. which was modified so that the surface potential was measurable installing a potential meter while making amounts of the electric current and exposure of the corona charger variable) and underwent practical copying process of ten thousand times at high temperature and high humidity. Black paper potential (Vb), white paper potential (Vw) and residual potential (Vr) were measured at the initial copy and after making 10,000 copies.

In addition, for the evaluation of the image unsharpness, another drum was employed. The drum was exposed under nitrogen dioxide of 5 ppm for 10 minutes and was then installed immediately to the above-mentioned copier. The image quality was evaluated by visual observation.

The evaluation criteria were classified; A: no image unsharpness is found at all; B: some image unsharpness is found; C: remarkable image unsharpness is found.

(CGM-1)

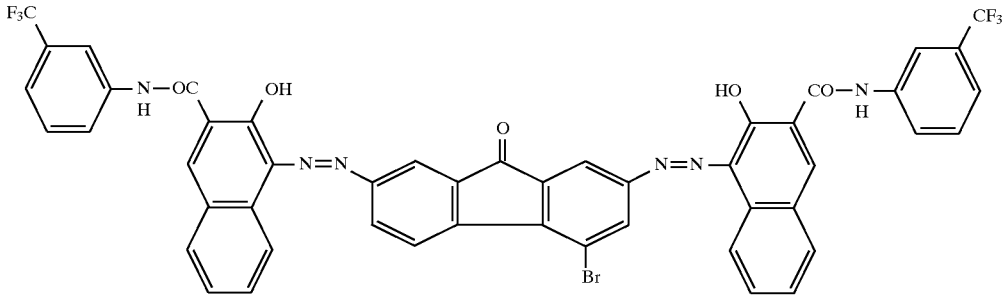

(H-1)

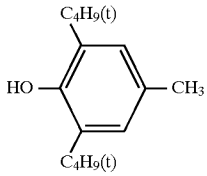

(H-2)

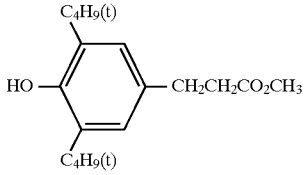

(A-1)

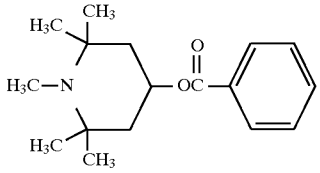

(AH-1)

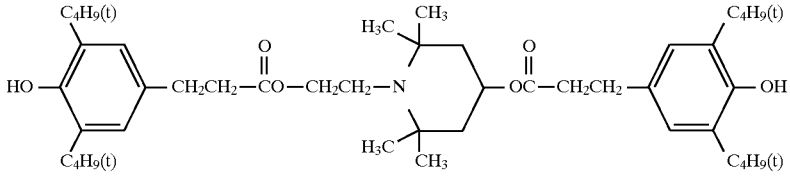

TABLE 1

| Photo-receptor | Anti-oxidant | Surface Potential of Photoreceptor (−V) Initial Vb | Vw | Vr | After 10,000 Copies Vb | Vw | Vr | Image Un-sharp-ness |
|---|---|---|---|---|---|---|---|---|
| P-1 | P-1 | 755 | 75 | 22 | 752 | 86 | 53 | A |
| P-2 | P-2 | 752 | 78 | 21 | 750 | 89 | 51 | A |
| P-3 | P-3 | 759 | 81 | 26 | 755 | 93 | 59 | A |
| P-4 | P-4 | 745 | 83 | 24 | 741 | 96 | 60 | A |
| P-8 | P-8 | 755 | 77 | 23 | 750 | 89 | 55 | A |
| P-9 | P-9 | 749 | 75 | 20 | 745 | 84 | 55 | A |
| Compar-ative 01 | None | 755 | 83 | 24 | 680 | 93 | 62 | C |
| Compar-ative 02 | None | 758 | 91 | 28 | 687 | 101 | 67 | C |
| H-1 | H-1 | 760 | 90 | 29 | 755 | 105 | 69 | B |
| H-2 | H-2 | 762 | 89 | 28 | 758 | 103 | 68 | B |
| A-1 | A-1 | 756 | 95 | 32 | 780 | 210 | 180 | A |
| AH-1 | AH-1 | 761 | 90 | 30 | 773 | 155 | 105 | A |

It is found that the photoreceptors of the present invention are excellent in preventing the formation of the image unsharpness. On the contrary, though the conventional hindered phenol antioxidants (H-1), (H-2) are found to be effective in the improvement in the surface potential during the repeated test, no effect is resulted in the prevention of the formation of the image unsharpness and the initial sensitivity is somewhat inferior to that of no addition (Comparative 01) (may be due to the decrease in the CTM concentration). Furthermore, hindered amine compounds are effective in the prevention of the formation of the image unsharpness but the residual potential obtained in the repeated tests remarkably increases. The compound having a hindered amine structure and a phenol structure in the one molecule is effective in the prevention of the formation of the image unsharpness and results in the good initial sensitivity. However, the residual potential after 10,000 copies increases remarkably.

On the contrary, the compounds of the present invention result in no image unsharpness and little change in the potential during the repeated use. In addition, the initial sensitivity increases as compared to that of no addition. These are the excellent features of the compounds of the present invention which have not been obtained by the conventional antioxidants.

Example B

In Example A, the antioxidants of the present invention have been found to be effective in the increase in the sensitivity. Photoreceptors were then prepared in the same manner as in Example A, except that various kinds of CTMs were employed and P-1 was employed as a fixed antioxidant and the initial sensitivity was measured at normal temperature and humidity. Because the sensitivity and electrification properties varied according to the change in the CTM under employing the same CGM, for each CTM, the initial black paper potential (Vb) and the white paper potential (Vw) were adjusted to the range of 740 to 760 V and 70 to 90 V, respectively by regulating the amounts of electric current and exposure of the corona charger, while utilizing the samples (each 01) having no antioxidant as a standard.

Inventive samples 26, 31, 35, 41 and 53 were prepared in the same manner as in Inventive sample P-1 of Example A, except that, instead of triphenyl amine CTM compound 2–3, each charge transport compound of those samples was changed with triphenyl amine CTM compounds 2–6, 3–1, 3–5, 4–1 and 5–3 respectively.

Comparative samples 26–01, 31–01, 35–01, 41–01 and 53–01 were respectively prepared in the same manner as in Inventive Samples 26, 31, 35, 41 and 53, except that antioxidant P-1 was not respectively employed.

Comparative samples 26–02, 31–02, 35–02, 41–02 and 53–02 were respectively prepared in the same manner as in Inventive Samples 26, 31, 35, 41 and 53, except that, instead of antioxidant P-1, a polycarbonate resin (Z200 made by Mitsubishi Gas Chemical Co., Inc) was respectively employed.

Comparative sample ED was prepared in the same manner as in Inventive Sample 26, except that compound ED1 was employed instead of CTM compound 2–6.

Comparative samples ED-01 and ED-02 were prepared in the same manner as in Sample ED, except that, in Sample ED-01, antioxidant P-1 was employed, and in ED-02, a polycarbonate resin (Z200 made by Mitsubishi Gas Chemical Co., Inc) was employed instead of antioxidant P-1.

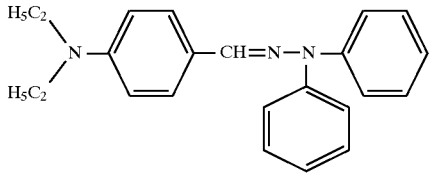

ED1

TABLE 2

| Photoreceptor | CTM | Antioxidant | Surface Potential of Photoreceptor (−V) Vb | Vw | Vr |
|---|---|---|---|---|---|
| 26 | (2-6) | Present | 758 | 75 | 23 |
| 26-01 | (2-6) | None | 755 | 80 | 24 |
| 26-02 | (2-6) | None | 760 | 88 | 27 |
| 31 | (3-1) | Present | 755 | 80 | 22 |
| 31-01 | (3-1) | None | 753 | 84 | 26 |
| 31-02 | (3-1) | None | 758 | 92 | 29 |
| 35 | (3-5) | Present | 757 | 74 | 22 |
| 35-01 | (3-5) | None | 756 | 80 | 25 |
| 35-02 | (3-5) | None | 760 | 87 | 27 |
| 41 | (4-1) | Present | 760 | 76 | 24 |
| 41-01 | (4-1) | None | 758 | 82 | 26 |
| 41-02 | (4-1) | None | 762 | 90 | 28 |
| 53 | (5-3) | Present | 758 | 83 | 32 |
| 53-01 | (5-3) | None | 755 | 82 | 33 |
| 53-02 | (5-3) | None | 760 | 90 | 37 |
| ED | (ED1) | Present | 759 | 90 | 40 |
| ED-01 | (ED1) | None | 754 | 82 | 36 |
| ED-02 | (ED1) | None | 760 | 91 | 41 |

It is found that the combinations of the antioxidants of the present invention with the CTM employed in Example result definitely in the increase in the sensitivity. Further, in comparison between Samples 53 and 53–01 in which the CTM concentration is not decreased with the addition of the antioxidant, it is found that the sensitivity Vw of 83 of Sample 53 is similar as the sensitivity Vw of 82 of Sample 53–01.

On the contrary, it is found that the sample in which the hydrazone CMT (ED1) employed for the comparison results in the decrease in the sensitivity corresponding to the decrease in the concentration of the CMT by the addition of the antioxidant.

Example C

Preparation of Photoreceptor 3–1 of the Present Invention

Aluminum was sputtered on a polyester support. To 800 ml of dichloroethane were then added 25 g of dibromoanthoanthrone as a charge generation material, a compound (2–4) as a charge transport material, 100 g of a polycarbonate resin (Z200 manufactured by MITSUBISHI GAS CHEMICAL CO., INC.) and further 5 g of compound P-1 of the present invention, and the resulting mixture was dispersed using a ball mill to prepare a dispersion. The resulting dispersion was coated on the above-mentioned polyester support at a thickness of 25 μm and the single-layered positively charged photoreceptor 3–1 of the invention was prepared.

Dibromoanthoanthrone

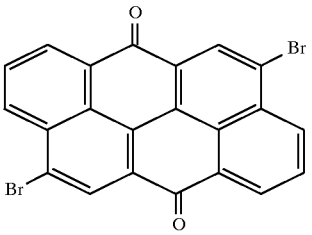

Preparation of Comparative Photoreceptors 3-2, 3-3 and 3-4

A comparative photoreceptor 3–2 was prepared in the same manner as in Example 3–1 except that compound P-1 of the present invention was not employed.

Comparative photoreceptors 3–3 and 3–4 were prepared in the same manner as in Example 3–1 except that hindered phenol compound H-1 or H-2 was employed instead of the compound P-1 of the present invention.

Evaluation

The photoreceptors of Example 3–1 and Comparative Examples 3–2, 3–3 and 3–4 were loaded to the Electrostatic Tester (EPA8100 manufactured by Kawaguchi Denki Co., Ltd.) equipped with the Ozone Generator (O-12 manufactured by Nihon Ozone Co., Ltd.) and the Ozone Monitor (EG-2001 Type manufactured by Ebara Jitsugyo Co., Ltd.); were subjected to corona discharge of +6 kV; were charged and were left for 5 seconds in the dark. Initial potential $V_0$ of each sample was then measured. The samples were then illuminated by light and the decay of the initial potential $V_0$ was measured. The amount of light which reduced the potential to one half was termed sensitivity (E1/2). Ozone gas was then introduced. After holding the concentration of ozone at 90 ppm for 3 hours, the ozone gas was removed and the samples were rested for 3 hours. Charge potential ($V_0'$) was then measured.

Evaluation Results

It is found that as compared to the Comparative Examples 3–3 and 3–4 wherein the conventional hindered phenol compound H-1 or H-2 is employed, the photoreceptor 3–1 of the present invention to which the compound P-1 of the present invention is added results in small variation in the charge potential after the introduction of ozone. Though the cause has not been clarified yet, it is estimated that the phenyl group at the position 4 stabilizes the excited state of the phenol structure and radicals generated by active ozone are efficiently deactivated (quenched). Furthermore, it is found that the sensitivity of the photoreceptor comprising the compound P-1 of the present invention increases as compared to the comparative photoreceptors 3–2, 3–3 and 3–4.

According to the above results, the compounds of the present invention is effective in the single-layered positively charged photoreceptor. Obtained results are show in Table 3.

TABLE 3

| | | Vo | E1/2 | Vo' |
|---|---|---|---|---|
| Sample | 3-1 | 850 | 3.90 | 825 |
| Comparative Sample | 3-2 | 845 | 3.92 | 720 |
| | 3-3 | 860 | 4.01 | 810 |
| | 3-4 | 855 | 4.02 | 805 |

What is claimed is:

1. An electrophotographic photoreceptor comprising a substrate and provided thereon, a photosensitive layer comprising a charge generation material, a triarylamine charge transport material, and a compound represented by Formula 1:

Formula 1

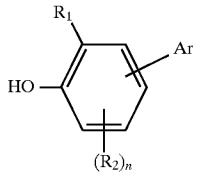

wherein $R_1$ represents a secondary or tertiary alkyl group; $R_2$ represents a halogen atom, an alkyl group, an aryl group or an alkoxyl group; n represents an integer of 0 to 3, and Ar represents an aryl group.

2. The electrophotographic photoreceptor of claim 1, wherein Ar is a phenyl group.

3. The electrophotographic photoreceptor of claim 1, wherein said Ar is positioned at the ortho-position or the para-position of said OH group of Formula 1.

4. The electrophotographic photoreceptor of claim 1, wherein said Ar is positioned at the para-position of said OH group of Formula 1.

5. The electrophotographic photoreceptor of claim 1, wherein said n of Formula 1 is 1.

6. The electrophotographic photoreceptor of claim 1, wherein said triarylamine charge transport material is a triphenyamine charge transport material.

7. The electrophotographic photoreceptor of claim 1, wherein said triarylamine charge transport material is a compound selected from a group consisting of the following Formulas 2, 3, 4 and 5:

Formula 2

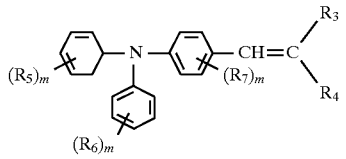

Formula 3

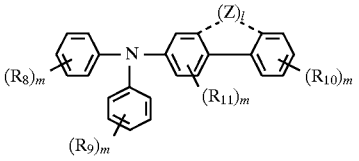

Formula 4

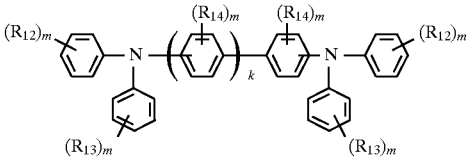

-continued

Formula 5

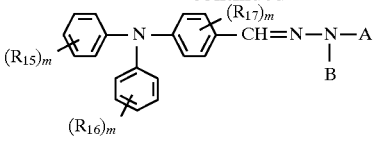

wherein $R_3$ represents a phenyl group; $R_4$ represents a hydrogen atom or a phenyl group; $R_5$ through $R_{17}$ each represent a halogen atom, an alkyl group or an alkoxyl group; m represents an integer of 0 to 3; A and B each represent an alkyl group or an aryl group; A and B may be combined to form a ring; Z represents a bonding group; l is 0 or 1; and k represents 0 or 1.

8. The electrophotographic photoreceptor of claim 6, wherein said triarylamine charge transport material is selected from a group consisting of said Formulas 2, 3 and 4.

9. The photoreceptor of claim 1, wherein the photosensitive layer comprises a charge generation layer containing said charge generation material and a charge transport layer containing said triarylamine charge transport material, and wherein the charge transport layer further contains the compound represented by Formula 1.

10. The photoreceptor of claim 9, wherein the amount of the compound represented by Formula 1 in said charge transport layer is from 0.1 to 100 weight parts of the amount of the triarylamine charge transport material.

11. The photoreceptor of claim 1, wherein the amount of the compound represented by Formula 1 is from 0.1 to 100 weight parts of the amount of the triarylamine charge transport material.

12. The photoreceptor of claim 1, wherein the photosensitive layer comprises a charge generation layer containing said charge generation material and a charge transport layer containing said triarylamine charge transport material; and wherein the charge transport layer further contains the compound represented by Formula 1 in an amount of from 0.1 to 100 weight parts of the amount of the triarylamine charge transport material; and the triarylamine charge transport material is selected from a group consisting of formulas 2, 3, 4 and 5:

Formula 2

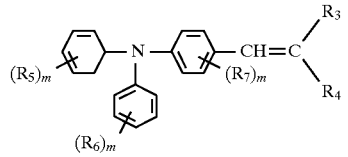

Formula 3

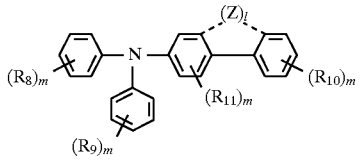

Formula 4

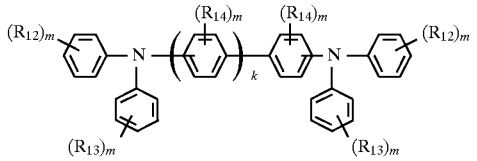

Formula 5

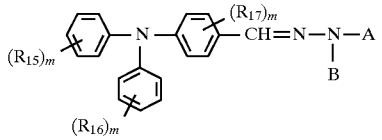

wherein $R_3$ represents a phenyl group; $R_4$ represents a hydrogen atom or a phenyl group; $R_5$ through $R_{17}$ each represent a halogen atom, an alkyl group or an alkoxyl group; m represents an integer of 0 to 3; A and B each represent an alkyl group or an aryl group; A and B may be combined to form a ring; Z represents a bonding group; l is 0 or 1; and k represents 0 or 1.

13. The photoreceptor of claim 12, wherein the compound of Formula 1 is selected from the group consisting of P-1–P-10 and P-11; the compound of Formula 2 is selected from the group consisting of (2–1)–(2–10) and (2-11); the compound of Formula 3 is selected from the group consisting of (3–1)–(3–5) and (3–6); the compound of Formula 4 is selected from the group consisting (4–1)–(4–6) and (4–7); and the compound of Formula 5 is selected from the group consisting of (5–1)–(5–4) and (5–5) all as shown below:

P-1

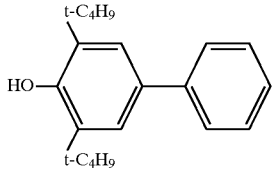

P-2

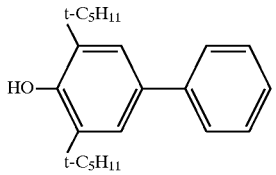

-continued
P-3
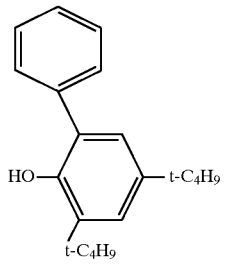
P-4
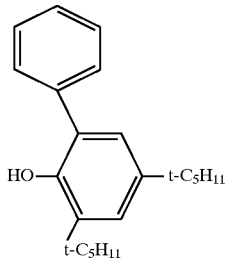
P-5
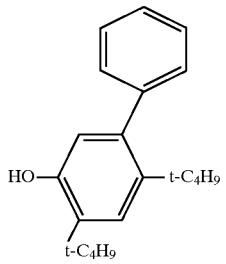
P-6
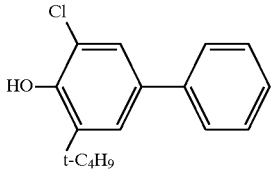
P-7
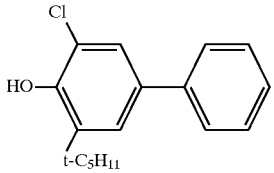
P-8
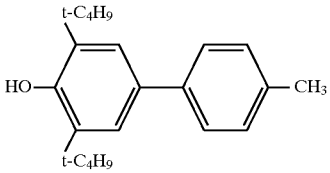
P-9
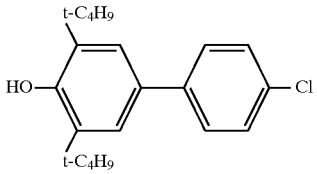

-continued
P-10
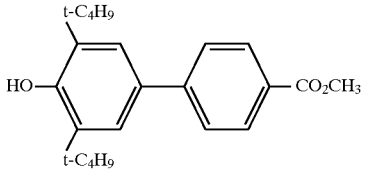
P-11
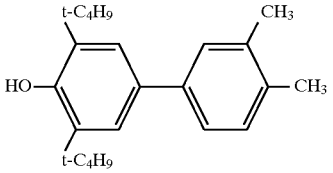
(2-1)
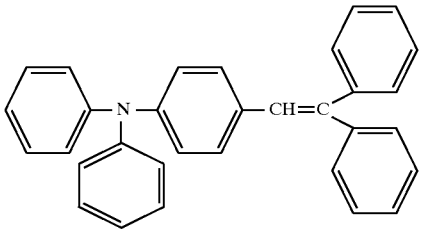
(2-2)
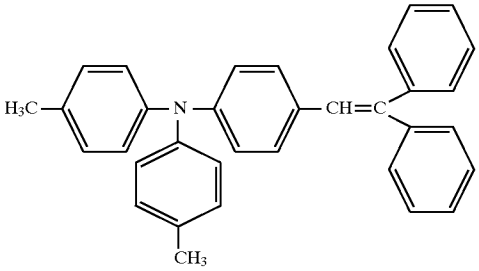
(2-3)
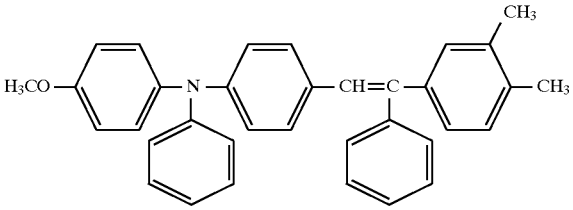
(2-4)
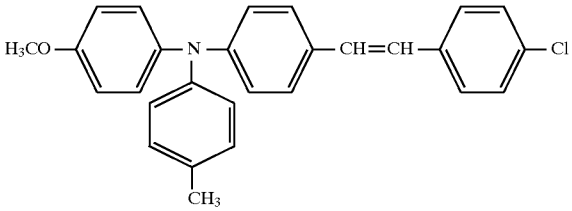
(2-5)
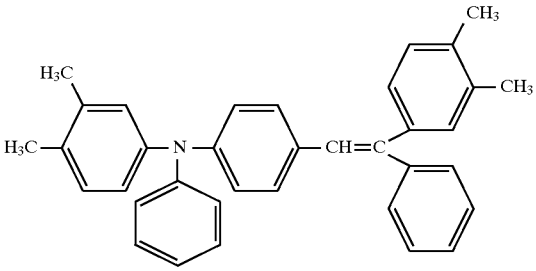

-continued
(2-6)
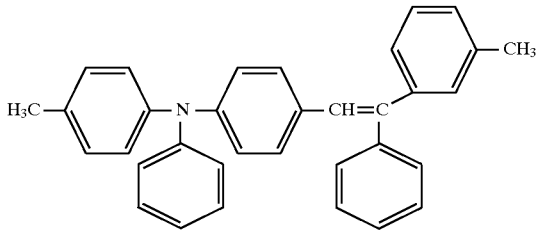
(2-7)
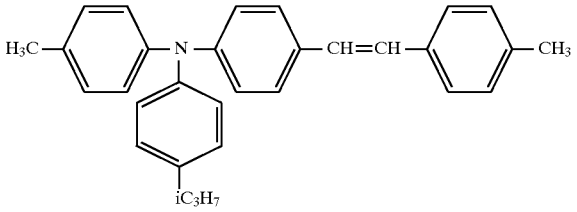
(2-8)
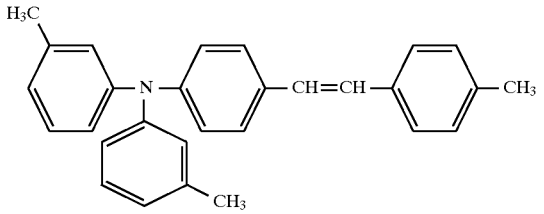
(2-9)
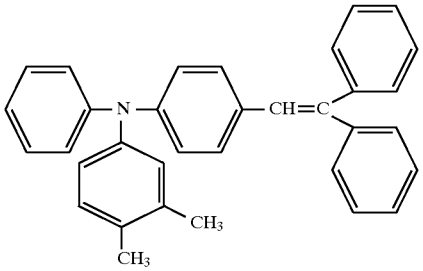
(2-10)
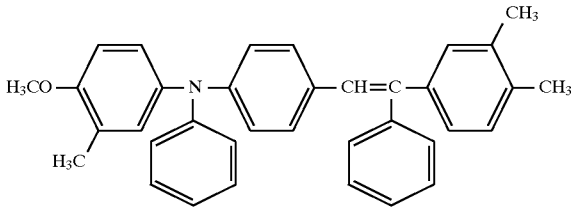
(2-11)
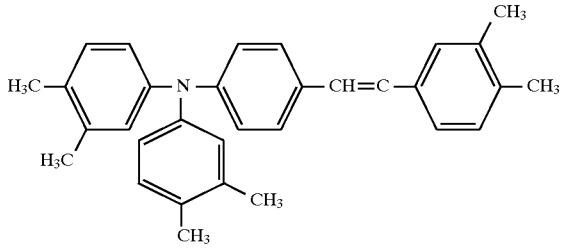

-continued
(3-1)
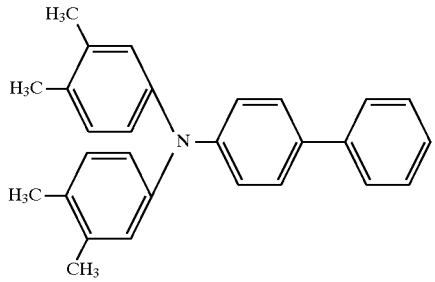
(3-2)
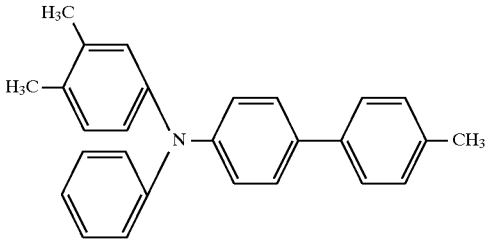
(3-3)
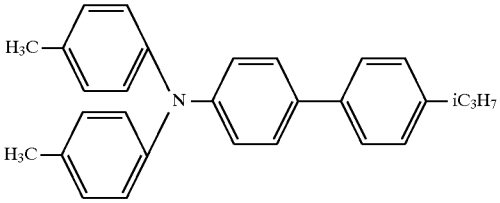
(3-4)
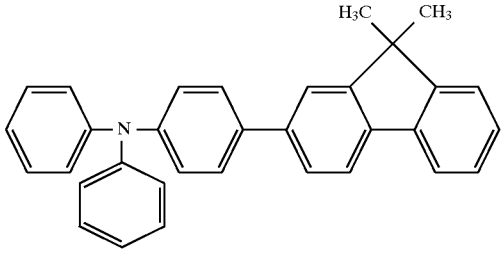
(3-5)
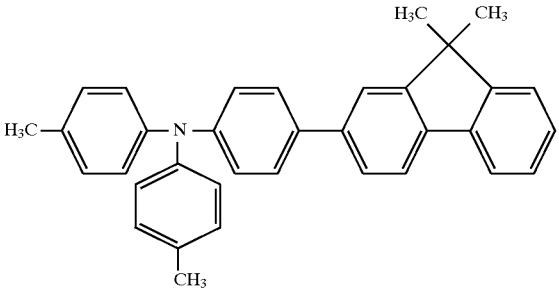
(3-6)
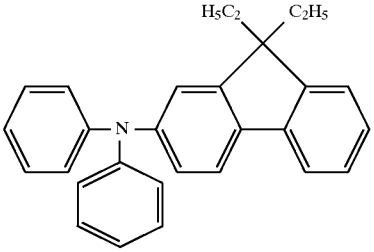

-continued
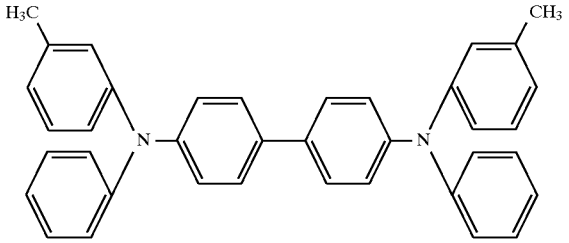
(4-1)
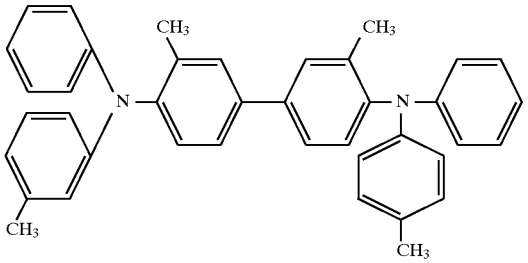
(4-2)
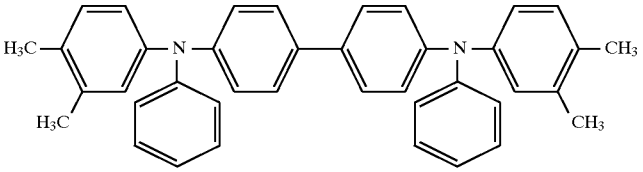
(4-3)
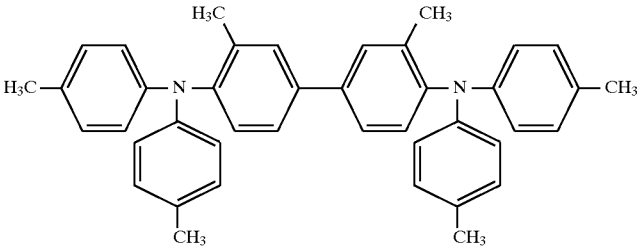
(4-4)
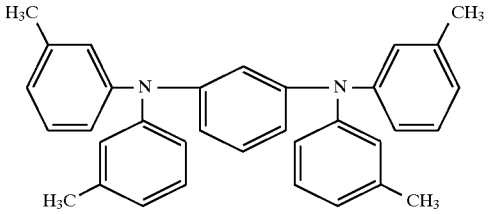
(4-5)
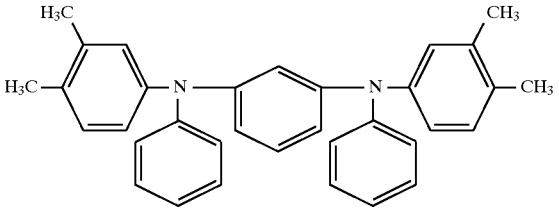
(4-6)
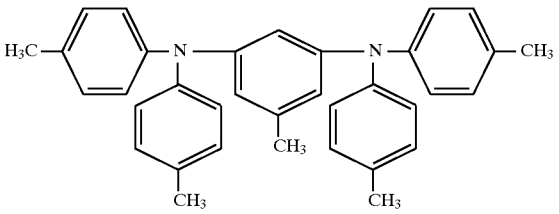
(4-7)

-continued

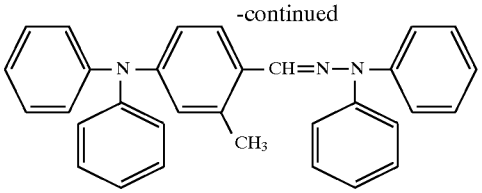

(5-1)

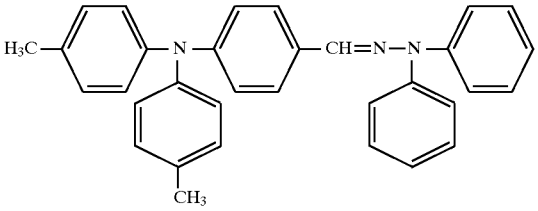

(5-2)

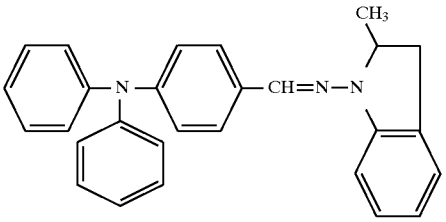

(5-3)

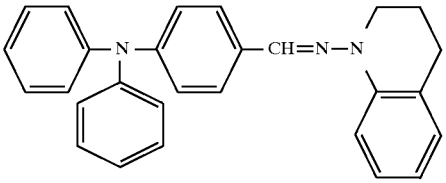

(5-4)

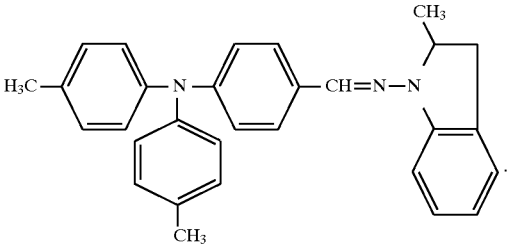

(5-5)

14. The photoreceptor of claim 1, wherein the photosensitive layer comprises a charge generation layer and a charge transport layer, the charge transport layer contains a compound represented by Formula 1 in an amount of from 0.1 to 100 weight parts of the amount of the triarylamine charge transport material; and the triarylamine charge transport material is selected from a group consisting of formulas 2, 3, and 4:

Formula 2

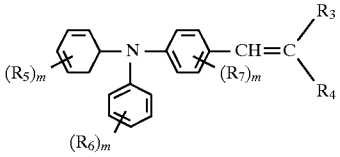

-continued

Formula 3

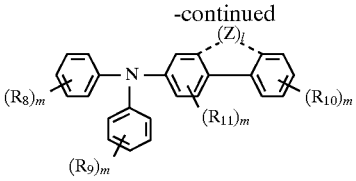

Formula 4

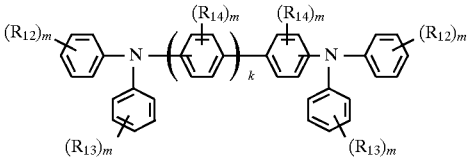

wherein $R_3$ represents a phenyl group; $R_4$ represents a hydrogen atom or a phenyl group; $R_5$ through $R_{14}$ each represent a halogen atom, an alkyl group or an alkoxyl group; m represents an integer of 0 to 3; Z represents a bonding group; l is 0 or 1; and k represents 0 or 1.

* * * * *